US006396049B1

(12) United States Patent
Estrera et al.

(10) Patent No.: US 6,396,049 B1
(45) Date of Patent: May 28, 2002

(54) MICROCHANNEL PLATE HAVING AN ENHANCED COATING

(75) Inventors: Joseph P. Estrera, Dallas, TX (US); Michael J. Iosue, Phoenix, AZ (US); Adriana Giordana; John W. Glesener, both of Richardson, TX (US)

(73) Assignee: Northrop Grumman Corporation, Los Angeles, CA (US)

( * ) Notice: Subject to any disclaimer, the term of this patent is extended or adjusted under 35 U.S.C. 154(b) by 0 days.

(21) Appl. No.: 09/494,879

(22) Filed: Jan. 31, 2000

(51) Int. Cl.[7] ..... H01J 31/26; H01J 31/50; H01J 43/00

(52) U.S. Cl. ..... 250/214 VT; 313/528; 313/534; 313/103 CM; 313/105 CM; 427/78

(58) Field of Search ..... 250/207, 214 VT; 313/523, 526, 528, 532, 533, 534, 535, 536, 103 R, 103 CM, 104, 105 R, 105 CM; 345/75.2; 427/77, 78, 126.1, 126.3, 126.4

(56) References Cited

U.S. PATENT DOCUMENTS

| | | | | | |
|---|---|---|---|---|---|
| 3,760,216 | A | * | 9/1973 | Lasser et al. | 313/103 CM |
| 3,777,201 | A | * | 12/1973 | Einstein | 313/526 |
| 4,051,403 | A | * | 9/1977 | Feingold et al. | 313/105 CM |
| 5,159,231 | A | * | 10/1992 | Feller et al. | 313/103 CM |
| 5,729,244 | A | * | 3/1998 | Lockwood | 345/75.2 |
| 6,040,000 | A | * | 3/2000 | Floryan et al. | 427/78 |

OTHER PUBLICATIONS

International Search Report in PCT International Application No. PCT/US00/34589, dated Mar. 9, 2001, 5 pages.

* cited by examiner

*Primary Examiner*—Stephone B Allen
(74) *Attorney, Agent, or Firm*—Baker Botts L.L.P.

(57) ABSTRACT

An improved microchannel plate (24) is disclosed. The microchannel plate has an input side (24*a*) and an output side (24*b*). A coating (32) is applied to the input side (24*a*) to increase secondary electron production and to prevent ions from leaving the microchannel plate (24) and damaging the photocathode (22).

19 Claims, 1 Drawing Sheet

*FIG. 2*

MICROCHANNEL PLATE HAVING AN ENHANCED COATING

TECHNICAL FIELD OF THE INVENTION

This invention relates to enhanced vision system and, more particularly, to a microchannel plate having an enhanced coating.

BACKGROUND OF THE INVENTION

While night vision technology has evolved to a state where it provides a useful product for both civilian and military use, it is always a goal to increase performance of such equipment.

One way to improve enhanced vision systems is to improve the microchannel plates utilized in the enhanced vision system. In standard microchannel plates the input and output side of them microchannel plate has a coating applied that allows for an electric potential to be setup to help accelerate electrons. However, this coating is not optimized for the production of secondary electrons or as a passivation layer for preventing ion from escaping the microchannel plate and damaging the photocathode.

SUMMARY OF THE INVENTION

In accordance with the present invention, a microchannel plate having an enhanced signal to noise ratio is provided. The microchannel signal plate provides advantages over previously developed microchannel plates.

In one embodiment, an improved microchannel plate is disclosed. The microchannel plate has an input side and an output side. A coating is applied to the input side to increase secondary electron production and to prevent ions from leaving the microchannel plate surface and damaging the photocathode.

A technical advantage of the present invention is that the addition of the coating on the microchannel will act to prevent ions from escaping the microchannel plate during operation and impinging on the photocathode. Additionally, the coating will help to increase the production of secondary emission electrons. Additional technical advantages are readily apparent from the following figures, description and claims.

BRIEF DESCRIPTION OF THE DRAWINGS

For a more complete understanding of the present invention, the objects and advantages thereof, reference is now made to the following descriptions taken in connection with the accompanying drawings in which.

DETAILED DESCRIPTION OF THE DRAWINGS

Figure 1:
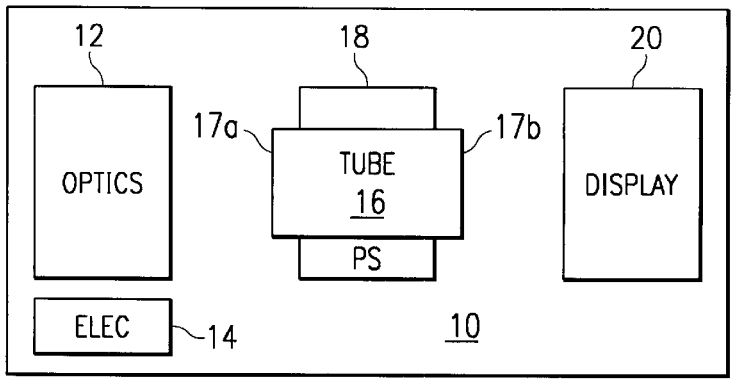
FIG. 1 is a schematic design of an image intensifier in accordance with the teachings of the present invention.
Figure 2:
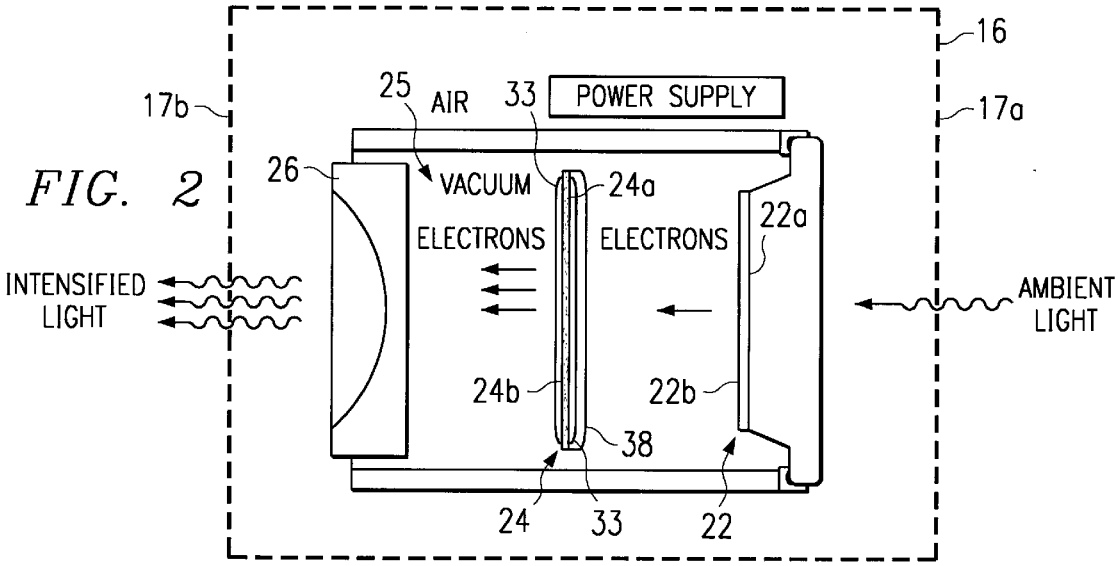
FIG. 2 illustrates an image intensifier tube in accordance with the teachings of the present invention; and, FIG. 3 illustrates a microchannel plate in accordance with the teachings of the present invention.
Figure 3:
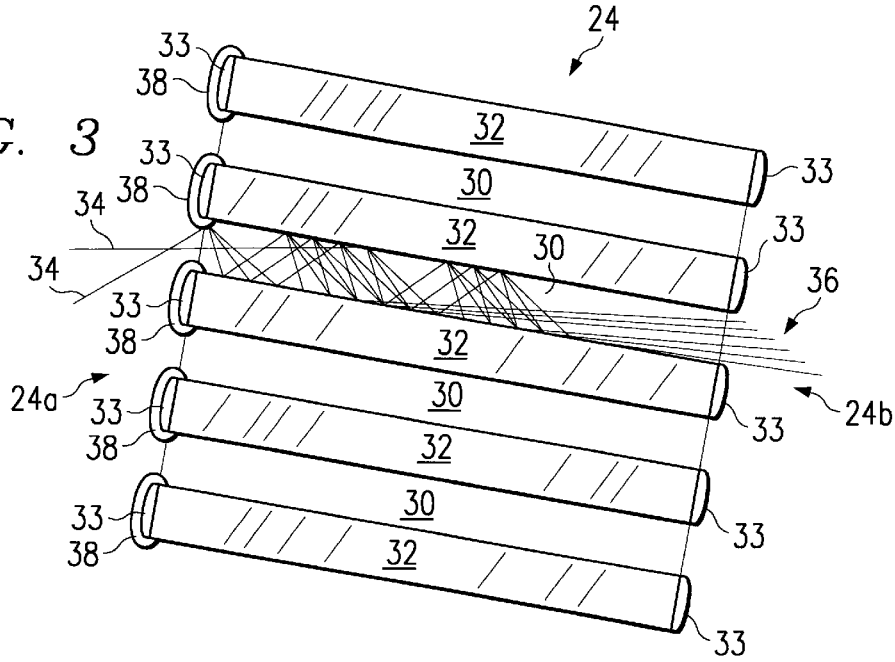

The preferred embodiment of the present invention and its advantages are best understood by referring to FIGS. 1 through 3 of the drawings, like numerals being used for like and corresponding parts of the various drawings.

FIG. 1 is a schematic design of an image intensifier 10 in accordance with the teachings of the present invention. Image intensifier 10 is operable to receive photons from an image and transform them into a viewable image. Image intensifier 10 is designed to operate and enhance viewing in varying light conditions including conditions where a scene is visible with natural vision and conditions where a scene is totally invisible with natural vision because the scene is illuminated only by star light or other infrared light sources. However, it will be understood that, although the image intensifier 10 may be used to enhance vision, the image intensifier 10 may also be used in other applications involving photon detection such as systems to inspect semiconductors.

Image intensifier 10 comprises optics 12 coupled to image intensifier tube 16. Image intensifier tube 16 has an input side 17*a* and an output side 17*b*. Image intensifier 10 is operable to act as a photon detector and image generator. Power supply 18 is coupled to image intensifier tube 16. Image intensifier tube 16 also can include a display 20 for enhancing the image produced by image intensifier tube 16.

Optics 12 are operable to focus light from a scene on to image intensifier tube 16.

Power supply 18 is operable to provide power to components of image intensifier tube 16. In a typical embodiment power supply 18 provides continuous DC power to image intensifier tube 16. The use of power supply 18 is further described in conjunction with FIG. 2.

Electronics 14 represents the other electronic necessary for image intensifier 10. These include electronics that are used to control among other things, power supply 16. Depending on the desired application of the image intensifier, electronics 14 may perform functions such as gating of the power supply and regulation of the tube gain.

Display 20 may be provided as convenient display for images generated by image intensifier tube 16. Display 20 may be optics which can deliver the images produced by image intensifier tube 16 to the user or may include the necessary electronics, such as a camera, in order to display the image produced by image intensifier tube 16 on a cathode ray tube (CRT) display or other display device.

FIG. 2 illustrates an image intensifier tube 16 in accordance with the teachings of the present invention. Image intensifier tube 16 comprises a photocathode 22 having a input side 22*a* and an output side 22*b*. Coupled to photocathode 22 is a microchannel plate (MCP) 24 having a MCP input side 24*a* and a MCP output side 24*b*. A first electric field 23 is located between photocathode 22 and microchannel plate 24. Also included is a phosphorous screen 26 coupled to microchannel plate 24. Between phosphorous screen 26 and microchannel plate 24 is a second electric field 25.

In operation, photons from an image impinge on input side of photocathode 22*a*. Photocathode 22 converts photons into electrons, which are emitted from output side of photocathode 22*b* in a pattern representative of the original image. Typically, photocathode 22 is a circular disk like structure manufactured from semiconductor materials mounted on a substrate as is well known in the art. One suitable arrangement may comprise gallium arsenide (GaAs) mounted on glass, fiber optics or similarly transparent substrate. Other arrangements can include indium gallium arsenide (InGaAs), alluminum gallium arsenide (AlGaAs), amorphic diamond, bi-alkali materials, other Group III–V alloys, or multilayer structures comprising several semiconductor materials.

The electrons emitted from photocathode 22 are accelerated in first electric field 23. First electric field 23 is generated by power supply 18. After accelerating in first electric field 23, the electrons impinge on the input side 24*a* of microchannel plate 24. Microchannel plate 24 typically comprises a thin glass wafer formed from many hollow fibers, each oriented slightly off axis with respect to incoming electrons. Microchannel plate 24 typically has a conductive electrode layer 33 disposed on MCP input side 24*a* and MCP output side 24*b*. A differential voltage, supplied by power supply 18, is applied across the MCP input 24*a* and MCP output 24*b*. Electrons from photocathode 22 enter microchannel plate 24 where they produce secondary electrons, which are accelerated by the differential voltage. The accelerated secondary electrons leave microchannel plate 24 at MCP output 24*b*.

Typically, microchannel plates are required to have a thin metal coating 33 on both the input side 24*a* and output side 33. This allows for an electric field to be applied across the MCP. Also, the deposited metal electrode assists in the production of secondary electrons. However, the metal coating is not necessarily optimized for production of secondary electron emissions.

In the present invention, a microchannel plate 24 with the conventional metallic coating is provided for use in an image intensifier. In the present invention, however, the input surface 24*a* of MCP 24 has a coating placed over it that produce more secondary electrons than the metallic coating and helps to prevent outgassing of ions that can damage the photocathode 22.

After exiting microchannel plate 24 and accelerating in second electric field 25, secondary electrons impinge on phosphorous screen 26, where a pattern replicating the original image is formed. Other ways of displaying an image such as using a charged coupled device, can also be used.

FIG. 3 illustrates a microchannel plate 24 in accordance with the teachings of the present invention. Illustrated is microchannel plate 24 comprising microchannel plate channels 30 and glass borders 32. As is illustrated in FIG. 3, incoming electrons 34 produce secondary emission electrons 36 by interactions in MCP 24.

In the present invention MCP input side 24*a* may or may not have an ion barrier film applied. The cladding glass used to manufacture microchannel plate 24 is made electrically conductive to produce secondary emission electrons by adding a conventional coating 33, such as nichrome. As discussed earlier, the input face (MCP input side 24*a*) is covered with a second coating 38. This coating can be materials such as $Al_2O_3$, $Si_3N_4$, GaP, or $SiO_2$. Such materials can be in single crystal, polycrystalline, or amorphous form. Coating 38 can also be formed of sputtered quartz, doped glass or other materials that produce a high secondary electron emission yield. Conductive materials such as for example Ti or Ti alloys, Au, Ag, W or W alloys, Al or Al alloys or other suitable metals and alloys, or highly doped semiconductor materials such as for example Si and alloys Ge and alloys, GaN, or SiC, could also be used to form layer 38. This embodiment has the advantage that on the input side of the MCP, layers 33 and 38 can be replaced by a single layer 38. Coating 38 can also comprise a multilayer structure including thin layers or quantum wells of some of the materials discussed in the previous paragraphs Additionally, coating 38 serves to passivate the surface of microchannel plate 24. This means that it will serve to prevent ions from leaving MCP 24 during operation in a vacuum and thus protects photocathode 22 from ion damage. The thickness of the coating depends on the type of material used and its crystalline structure. The thickness is optimized so as to minimize the obstruction to the flow of electrons from the photocathode into the MCP while maximizing the reduction of the number of eletrons flowing from the MCP to the photocathode. In one embodiment a 10 nm thick coating of doped glass is applied. While the invention has been particularly shown and described by the foregoing detailed description, it will be understood by those skilled in the art that various other changes in form and detail may be made without departing from the spirit and scope of the invention.

What is claimed is:

1. An improved microchannel plate comprising a plurality of channels and glass borders and wherein:

the channels are oriented off-axis with respect to electrons entering an input side of the microchannel plate; and the input side is coated with a passivation layer, the passivation layer extending into the channels without covering the hollows of the channels and operable to reduce the number of electrons flowing from the microchannel plate to the photocathode and to produce secondary electrons.

2. The microchannel plate of claim 1, wherein the passivation layer comprises a layer of $Al_2O_3$.

3. The microchannel plate of claim 1, wherein the passivation layer comprises a layer of silicon nitride.

4. The microchannel plate of claim 1, wherein the passivation layer comprises a layer of gallium phosphide.

5. The microchannel plate of claim 1, wherein passivation layer comprises a layer of gallium nitride.

6. The microchannel plate of claim 1, wherein the passivation layer comprises a layer of aluminum nitride.

7. The microchannel plate of claim 1, wherein the passivation layer comprises a material which produces more secondary electrons than a primary coating of the microchannel plate.

8. The microchannel plate of claim 1, wherein the passivation layer reduces the outgassing of ions.

9. A photon detector comprising a microchannel plate comprising a plurality of channels and glass borders and wherein:

the channels are oriented off-axis with respect to electrons entering an input side of the microchannel plate; and the input side is coated with a passivation layer, the passivation layer extending into the channels without covering the hollows of the channels and operable to reduce the number of electrons flowing from the microchannel plate to the photocathode and to produce secondary electrons.

10. The detector of claim 9, wherein the passivation layer comprises a layer of $Al_2O_3$.

11. The detector of claim 9, wherein the passivation layer comprises a layer of silicon nitride.

12. The detector of claim 9, wherein the passivation layer comprises a material which produces more secondary electrons than a primary coating of the microchannel plate.

13. The detector of claim 9, wherein the detector further comprises a photocathode coupled to the microchannel plate, the photocathode operable to convert incoming photons into electrons operable to be sent to the microchannel plate.

14. The detector of claim 9, wherein the passivation layer reduces the outgassing of ions.

15. A method for producing an enhanced microchannel plate comprising:

providing a microchannel plate comprising a plurality of channels and glass borders, wherein the channels are oriented off-axis with respect to electrons entering an input side of the microchannel plate; and coating the input side with a passivation layer extending into the channels without covering the hollows of the channels and operable to reduce the number of electrons flowing from the microchannel plate to the photocathode and to produce secondary electrons.

16. The method of claim 15, wherein the passivation layer comprises a layer of $Al_2O_3$.

17. The method of claim 15, wherein the passivation layer comprises a layer of silicon nitride.

18. The method of claim 15, wherein the passivation layer comprises a material which produces more secondary electrons than a primary coating of the microchannel plate.

19. The method of claim 15, wherein the passivation layer prevents the outgassing of ions.

* * * * *

UNITED STATES PATENT AND TRADEMARK OFFICE

CERTIFICATE OF CORRECTION

PATENT NO. : 6,396,049 B1 
DATED : May 28, 2002
INVENTOR(S) : Joseph P. Estrera et al.

It is certified that error appears in the above-identified patent and that said Letters Patent is hereby corrected as shown below:

Title page,
Item [73], Assignee: change "Northrop Grumman Corporation, Los Angeles, CA (US)" to -- Litton Systems, Inc. --.

Signed and Sealed this

Eighteenth Day of March, 2003

JAMES E. ROGAN
*Director of the United States Patent and Trademark Office*